US009404255B1

(12) United States Patent
Castro et al.

(10) Patent No.: US 9,404,255 B1
(45) Date of Patent: Aug. 2, 2016

(54) LIGHT-IN-WEIGHT CONCRETE BLOCKS AND METHOD

(71) Applicant: ARCA Global, LLC, Ponte Vedra Beach, FL (US)

(72) Inventors: Mauricio Castro, Orlando, FL (US); Marc Newman, Celebration, FL (US); Jon LaPlante, Rosemary, FL (US)

(73) Assignee: ARCA Global, LLC, Ponte Vedra Beach, FL (US)

( * ) Notice: Subject to any disclaimer, the term of this patent is extended or adjusted under 35 U.S.C. 154(b) by 0 days.

(21) Appl. No.: 14/669,449

(22) Filed: Mar. 26, 2015

(51) Int. Cl.
*E04C 1/39* (2006.01)

(52) U.S. Cl.
CPC ..... *E04C 1/39* (2013.01); *E04B 2103/02* (2013.01)

(58) Field of Classification Search
CPC ..... E04C 1/39; E04B 2103/02
See application file for complete search history.

(56) References Cited

U.S. PATENT DOCUMENTS 919,272 A * 4/1909 White ..... E04B 2/06 52/286
1,785,499 A * 12/1930 Sayers ..... E04B 2/42 52/437
2,241,169 A * 5/1941 Yokes ..... E04B 1/12 52/223.7
3,478,482 A * 11/1969 Weir ..... E04B 1/04 52/125.2
3,968,615 A * 7/1976 Ivany ..... E04B 2/8629 52/259
4,075,808 A * 2/1978 Pearlman ..... E04B 2/54 52/439
4,115,980 A * 9/1978 Martel ..... E04B 2/46 446/124
4,272,940 A * 6/1981 Nicolls ..... E04B 2/18 52/591.1
5,226,276 A * 7/1993 Cahill ..... E04C 2/40 52/592.6
5,379,565 A * 1/1995 Vienne ..... E04B 2/18 52/605
5,685,119 A * 11/1997 Zschoppe ..... E04B 2/44 52/570
5,715,635 A * 2/1998 Sherwood ..... E04B 2/16 52/286
5,899,040 A * 5/1999 Cerrato ..... E04B 2/08 52/223.7
5,901,520 A * 5/1999 Abdul-Baki ..... E04B 2/16 52/421
6,122,880 A * 9/2000 Kolb ..... E04C 1/40 52/426
6,122,881 A * 9/2000 Aubertot ..... E04B 2/14 52/596
6,223,493 B1 * 5/2001 Ruggeri ..... E04B 2/16 52/592.6
6,244,009 B1 * 6/2001 Cerrato ..... E04B 2/08 52/223.7
6,508,038 B2 * 1/2003 Al-Ghitta ..... E04B 2/16 405/284
6,588,168 B2 * 7/2003 Walters ..... E04B 2/14 52/604

(Continued)

*Primary Examiner* — Rodney Mintz
(74) *Attorney, Agent, or Firm* — David P. Hendricks; Ronald E. Smith; Smith & Hopen, P.A.

(57) ABSTRACT

Construction blocks include transversely disposed first and second end walls, longitudinally disposed first and second sidewalls, and longitudinally disposed top and bottom walls. A recess is formed in a first end wall, a protuberance is formed in a second end wall and the recess receives the protuberance when the blocks are laid end-to-end. A longitudinally-extending protuberance is formed in the top wall, and a longitudinally-extending recess is formed in the bottom wall and receives the top wall protuberance when the blocks are vertically stacked. A pair of parallel, longitudinally-extending ledges is formed in the top wall of each block by the top wall protuberance and each ledge receives an associated bottom edge of a sidewall when the blocks are vertically stacked.

8 Claims, 5 Drawing Sheets

(56) References Cited

U.S. PATENT DOCUMENTS 6,665,994 B1 * 12/2003 Ruggeri ..... E04B 2/14 52/592.6
6,746,532 B2 6/2004 Boronkay
6,931,803 B1 * 8/2005 Davis ..... E04B 1/28 52/251
7,108,577 B2 * 9/2006 Peters ..... A63H 33/084 446/124
7,584,584 B2 * 9/2009 Fennell, Jr. ..... E04C 1/40 52/405.3
7,610,730 B2 * 11/2009 O'Connor ..... E04B 2/16 52/442
8,225,578 B2 * 7/2012 Azizi Ronagh ..... E04B 2/16 52/285.2
8,266,862 B2 * 9/2012 Huang ..... E04C 2/044 52/436
8,800,230 B2 * 8/2014 O'Connor ..... E04B 2/16 52/442
8,839,593 B2 * 9/2014 Barrett ..... E04H 12/12 52/404.1
8,887,466 B2 * 11/2014 Alvarez Moysen ..... E04B 2/18 52/220.2
9,021,762 B1 * 5/2015 DePalma ..... E04B 2/14 52/596
2002/0038532 A1 * 4/2002 Huberty ..... B28B 7/24 52/596
2004/0020155 A1 * 2/2004 Correa ..... E04B 2/16 52/604
2007/0199273 A1 * 8/2007 Wang ..... E04B 2/08 52/604
2007/0204548 A1 * 9/2007 Gagne ..... E04B 2/06 52/604
2010/0043335 A1 * 2/2010 O'Connor ..... E04B 2/16 52/592.6
2013/0204080 A1 * 8/2013 Gibson, II ..... A61F 5/41 600/38
2013/0205705 A1 * 8/2013 Bilka ..... E04B 2/44 52/604
2014/0196397 A1 * 7/2014 Sourlis ..... E04C 1/41 52/503

* cited by examiner

LIGHT-IN-WEIGHT CONCRETE BLOCKS AND METHOD

BACKGROUND OF THE INVENTION

1. Field of the Invention

This invention relates, generally, to cement blocks having general utility as building materials and having enhanced utility as building materials in earthquake zones, enhanced resistance to wind forces, and enhanced impact resistance. More particularly, it relates to cement blocks that are very light in weight and which have several features that facilitate construction with such blocks.

2. Description of the Prior Art

Conventional concrete or cement blocks are 15⅝" long× 7⅝" wide by 7⅝" tall. They occupy about 0.83 square feet and 0.53 cubic feet. Although they are relatively small, they are heavy and difficult to work with.

Thus there is a need for a cement block that is lighter in weight than a conventional block and which is therefore easier to work with and safer for use in earthquake zones, has enhanced resistance to wind forces, and enhanced impact resistance.

Conventional blocks have no alignment aids. Alignment therefore depends upon the skill of the installer.

Thus there is a need for a cement block having alignment aids to thereby reduce the skill required to align the blocks as needed.

Conventional blocks have two (2) square cells that require more concrete when filled.

Thus there is a need for a cement block that eliminates the two (2) square cells of conventional blocks.

Conventional blocks also have no horizontal channels for concrete, thereby making installation more difficult.

Thus there is a need for an improved block having horizontal channels for concrete.

Conventional blocks are also difficult to install because they lack offset grooves for horizontal rebar.

There is a need, therefore, for a block having offset grooves for rebar, thereby facilitating installation of the blocks.

However, in view of the prior art considered as a whole at the time the present invention was made, it was not obvious to those of ordinary skill in the art that conventional cement blocks were in need of improvement, and therefore it was not obvious how to improve the conventional blocks.

SUMMARY OF THE INVENTION

The long-standing but heretofore unfulfilled need for a light-in-weight construction block that facilitates construction and which is resistant to earthquakes is now met by a new, useful, and non-obvious invention.

Various embodiments of the novel construction block may comprise a first wall comprising a recessed area and a second end wall comprising a protruded area. The recessed area may be adapted to at least partially receive the first end wall protruded area therein when a first block is disposed in an end-to-end relation to a second block. The block may further comprise top and bottom walls. The top wall may comprise a protruded area and the bottom wall may comprise a channel that is adapted to at least partially receive the top wall protruded area therein when a first block is disposed in overlying relation to a second block. In addition, the block may comprise first and second side walls extending from the top wall to the bottom wall. Further, the block may comprises ledges formed in the top wall at an intersection of the top wall and each of the first and second side walls. The ledges may be adapted to receive bottom edges of the first and second side walls when a first block is disposed in overlying relation to a second block.

Additional embodiments of the construction block may comprise first and second end walls. At least a portion of one of the end walls may comprise a protrusion and at least a portion of the other end wall may comprise a recess adapted to receive the end wall protrusion therein when two blocks are disposed in an end-to-end relation to one another. The block may also comprise a top wall, at least a portion of which comprises a protrusion, and a bottom wall, at least a portion of which comprises a channel. The channel may be adapted to receive the top wall protrusion when two blocks are in overlying relation to one another. The block may further comprise first and second side walls extending from the top wall to the bottom wall. In addition, the block may comprise at least one bore extending from the top wall to the bottom wall and in communication with the channel to form a continuous hollow space within the block.

In still further embodiments, the construction block comprises transversely disposed first and second end walls disposed in parallel, longitudinally spaced apart relation to one another. The block may further comprise longitudinally disposed first and second sidewalls disposed in parallel, transversely spaced apart relation to one another and having a common length equal to the spacing between the first and second end walls and being formed integrally with the first and second end walls. Longitudinally disposed top and bottom walls may be disposed in parallel relation to one another and spaced apart from one another by a predetermined distance determined by a common height of the first and second sidewalls. The top and bottom walls may be formed integrally with the first and second sidewalls, and the top and bottom walls may be formed integrally with the first and second end walls. The block may also comprise a first end wall recessed relative to a first end of the block and a second end wall protruded relative to a second end of the block. The bottom wall may be recessed relative to a bottom edge of the sidewalls. A longitudinally-extending protrusion may be formed in the top wall and may have a width less than a width of the block. A pair of parallel, longitudinally-extending ledges may be formed in each block by the top wall protrusion.

The primary object of this invention is to provide a construction block that is keyed to interlock with adjacent (in both horizontal and vertical directions) blocks of the same design to facilitate construction.

A closely related object is to provide a cement block that is much lighter-in-weight than conventional cement blocks.

Still another object is to produce blocks that are substantially larger than conventional blocks so that fewer blocks are needed to complete a construction project.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
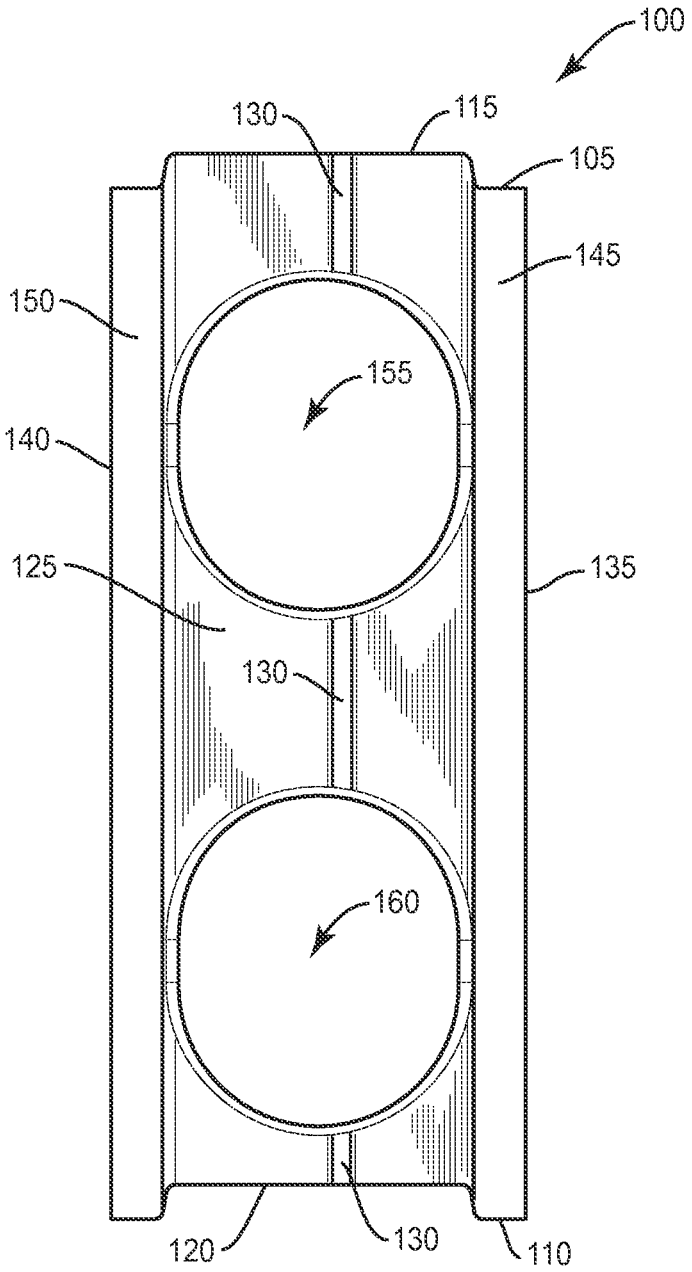
FIG. 1 is a plan view of a novel block.

The top wall and bottom wall of a conventional concrete masonry unit, also called concrete brick, concrete block, cement block, besser block, breeze block and cinder block, are flat and generally have a width of seven and five-eighths inches (7⅝") and a length of fifteen and five-eighths inches (15⅝"). Conventional flat top and bottom walls of confronting, vertically stacked blocks are spaced apart from one another by a layer of concrete. The blocks are not keyed to one another due to their respective flat surfaces and their proper alignment is thus the responsibility of the block layer.

Each novel block 100 has six (6) walls (top and bottom walls, first and second end walls, and two sidewalls), like conventional blocks, but four (4) of them are sculpted.

More particularly, referring to FIGS. 1 through 4, the first and second end walls, denoted 105 and 110, respectively, are sculpted to facilitate the longitudinal alignment of blocks 100, i.e., the sculpting of the first end wall 105 enables the first end wall 105 to key into the sculpting of a second end wall 110 of its longitudinally contiguous block. The first end wall 105 protrudes with respect to a conventional end wall forming protrusion 115, and the second end wall 110 is recessed with respect to a conventional end wall forming recess 120. The alternating protrusions 115 and recesses 120 enables the novel blocks 100 to interlock with one another when laid end to end, i.e., with each recess 120 receiving each protrusion 115 (for example, see FIG. 5). The recess 120 may partially or fully receive the protrusion 115 as needed for a particular design. For example, when an essentially flush design is desired, the recess 120 may fully receive the protrusion, allowing the first end wall 105 to contact the second end wall 110 of blocks laid end-to-end. Alternately, the design may require a gap between adjacent blocks 100, and the recess 120 may be sized (i.e., a depth of the recess 120) to only partially receive the protrusion 115 therein.

As illustrated in the Figures, both the protrusion 115 and the recess 120 have a generally rectangular shape. The shape of the protrusion 115 and the recess 120 may vary in different embodiments. For example, the protrusion 115 and the recess 120 may be oval, square, rectangular, triangular, or any other regular or irregular shape known in the art. However, testing has demonstrated that the rectangular shape illustrated in the Figures allows quick and easy alignment of the blocks 100 and is generally easier to manufacture than other shapes. The fact that the Figures only show rectangularly shaped protrusions 115 and recesses 120 is merely for convenience and does not imply any limitations on the design of the protrusion 115 and the recess 120 in various embodiments.

Figure 2:
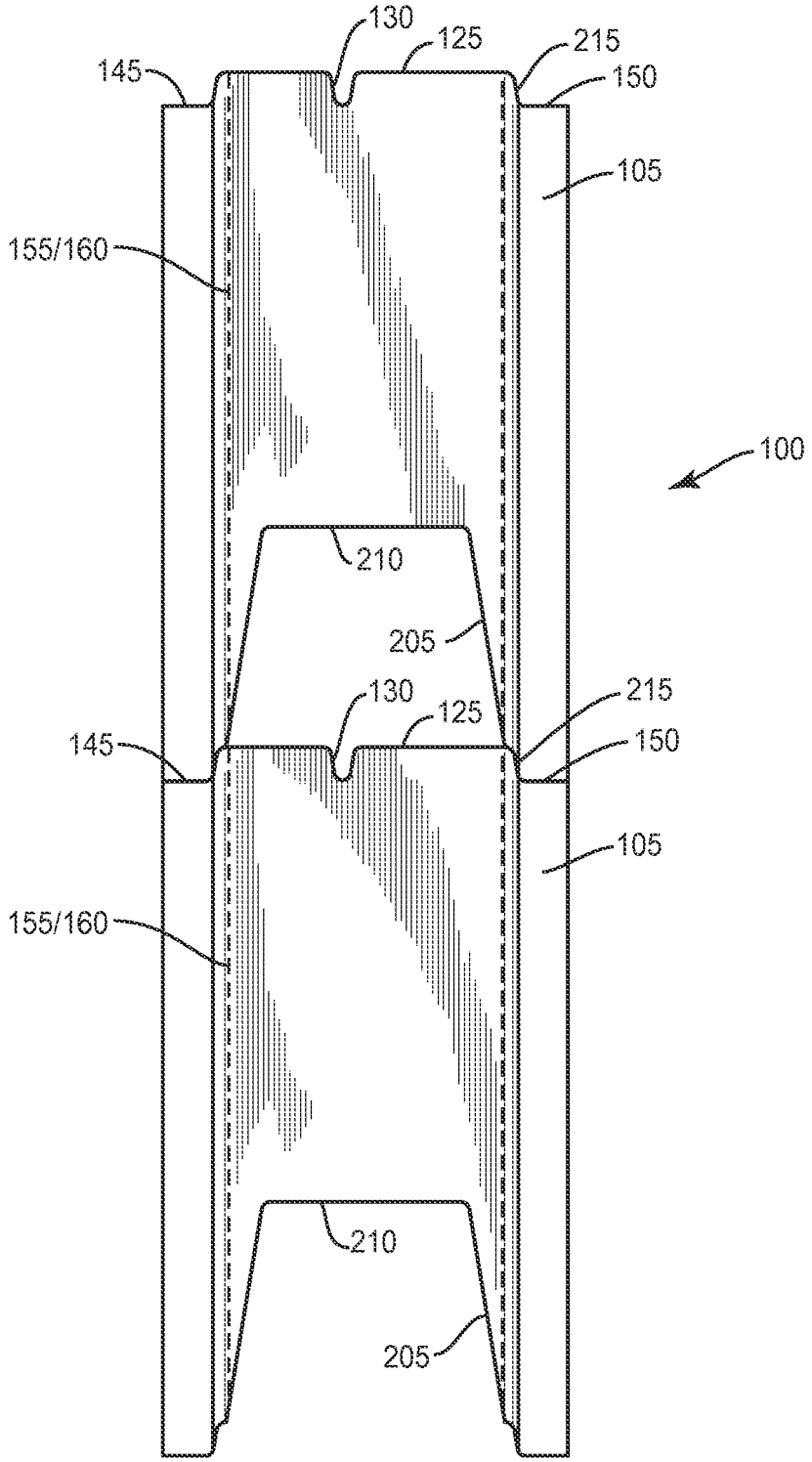
FIG. 2 is an end elevation view depicting a first novel block positioned atop a second novel block.
Figure 3:
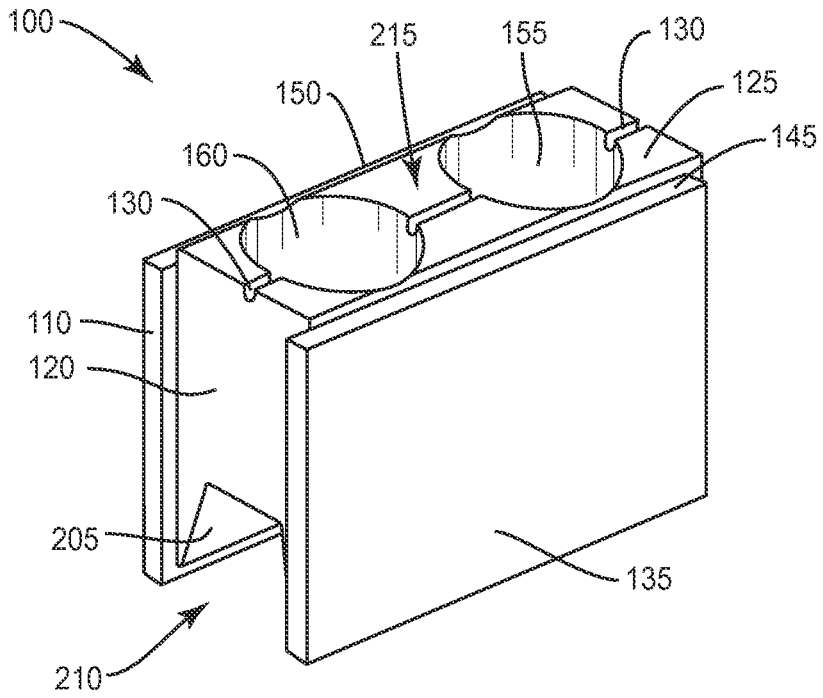
FIG. 3 is a perspective view from a first end wall of a novel block.
Figure 4:
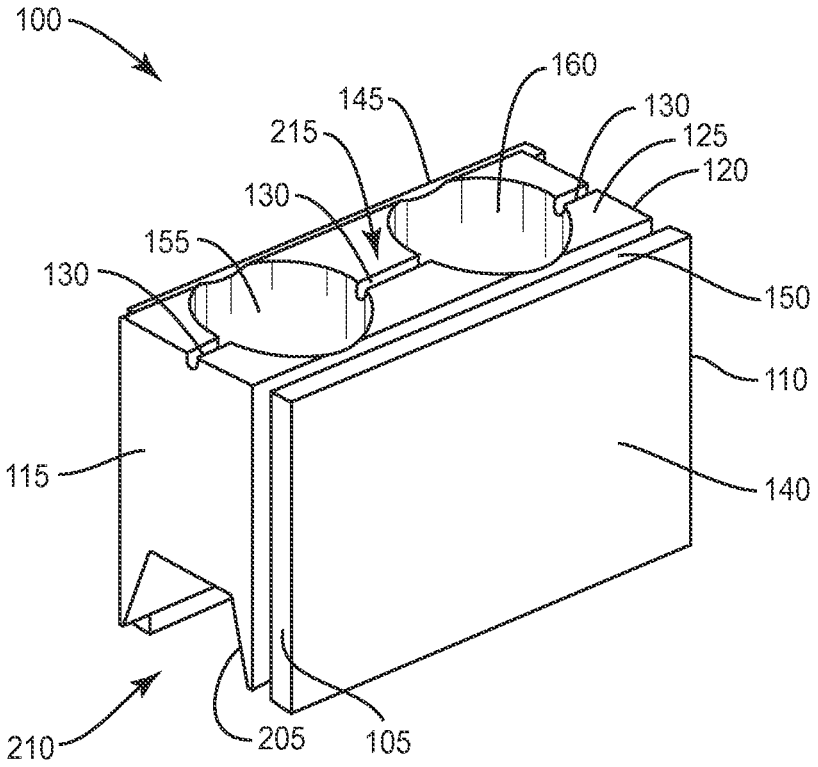
FIG. 4 is a perspective view from a second end wall of a novel block.

As depicted in FIG. 2, top and bottom walls 125 and 205, respectively, may be sculpted to facilitate the vertical stacking of blocks 100, i.e., the sculpting of the top wall 125 and the bottom wall 205 enables the top wall 125 to key into the sculpting of bottom wall 205. The sculpting of the top wall 125 forms a protrusion 215 generally extending from the first side wall 105 to the second side wall 110. The sculpting of the bottom wall 205 forms a channel 210 generally extending from the first end wall 105 to the second end wall 110. Although the Figures illustrate the channel 210 extending through each end wall 105, 110, various embodiments may comprise a channel 210 contained entirely within the end walls 105, 110 such that ends of the channel 210 do not extend through the end walls 105, 110.

The protrusion 215 of top wall 125 positions an upper surface of the top wall 125 about half an inch (½") above the uppermost edge of unsculpted sidewalls 140, 145. The protrusion 215 of the top wall 125 may have a width less than the width of the block 100 and may be centered with respect to a longitudinal axis of symmetry of the block 100, thereby creating longitudinally extending ledges 145, 150 of equal width. Each ledge 145, 150 may have the width of a sidewall 135, 140 so that the sidewalls 135, 140 of contiguous blocks 100 are flush with one another when blocks 100 are vertically stacked with respect to one another. The ledges 145, 150 and the sidewalls 135, 140 supported by them are therefore keyed to one another, thereby further facilitating flush vertical stacking of the novel blocks 100.

The channel 210 is formed in the bottom wall 205 and may have a height or depth of about six inches (6"). While other heights, both less than six inches and greater than six inches are within the scope of the present disclosure, experimentation has shown that a height of about six inches provides adequate room for concrete or other filler material to flow through the block as described in more detail below. The protrusion 215 is received within the channel 210 when blocks 100 are vertically stacked but most of the channel is unoccupied and filled with air, thereby further lightening each block without adversely affecting its structural integrity.

Figure 5:
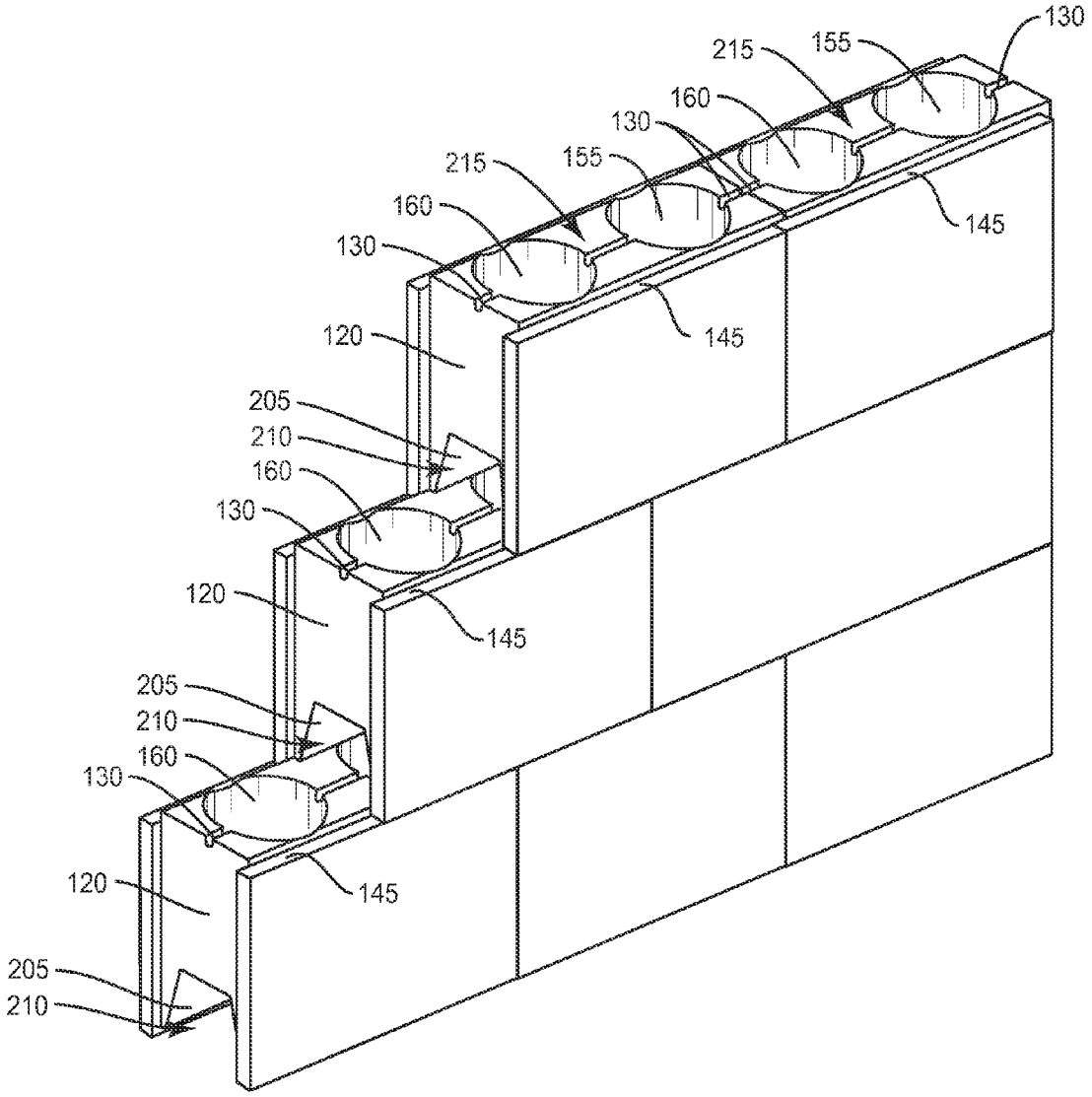
FIG. 5 is a perspective view of a plurality of the novel blocks in interconnected relation to one another.

Two circular bores 155, 160 may extend vertically through the block 100 from the top wall 125 to the bottom wall 205. Each of the bores 155, 160 may extend through the bottom wall 205 to the channel 210 thereby forming a continuous hollow space within the block 100. As illustrated in the Figures, each block 100 comprises two bores 155, 160. In various embodiments, the blocks 100 may comprise other numbers of bores, such as one, three, four, etc. However, testing has shown that the two-bore arrangement facilitates filling the hollow space with concrete or other filler material as described in more detail below, while simultaneously reducing the weight of the block 100. When the blocks 100 are stacked in a typical arrangement between rows as illustrated in FIG. 5, the blocks 100 may be offset by half the length of a block 100 from the previous row. Thus, in this arrangement bore 155 would align with bore 160 of the block 100 below it forming a continuous vertical passage through the structure.

Similarly, the shape of each bore 155, 160 may vary in different embodiments. For example, the bores 155, 160 may be oval, square, rectangular, triangular, or any other regular or irregular shape known in the art. The fact that the Figures only show two bores 155, 160 in each block 100 is merely for convenience and does not imply any limitations on the design of the bores 155, 160 in various embodiments.

The bores of conventional blocks as well as the novel blocks 100 of the present disclosure may be filled with concrete or other filler material during construction of a structure. The circular bore 155, 160 design of the present disclosure would require approximately 21 percent less filler material than a conventional block with square bores that would circumscribe the circular bores 155, 160, resulting in a material and labor savings when constructing a structure with the novel blocks 100.

A rebar-receiving channel 130 may be formed in each top wall 125 and may extend either coincident with or parallel to a longitudinal axis of symmetry of the block 100. As each row of blocks 100 is laid as depicted in FIG. 5, rebar may be placed within the rebar-receiving channel 130, then the next vertical row of blocks 100 may be laid. Once the hollow space is filled, the rebar will aid in forming a stronger structure. As shown in FIGS. 1 and 2, the rebar-receiving channel 130 may be offset from the longitudinal axis of symmetry of the block 100. While any positioning of the rebar-receiving channel 130 in the top wall 125 is within the scope of the present disclosure, a slight offset facilitates flow of cement or other filler material into the hollow space within the blocks 100. Similarly, the shape of the rebar-receiving channel 130 may be straight, as illustrated in FIG. 1, or any other shape known in the art to accommodate non-straight rebar such as curved, zig-zag, etc. Additional rebar may be placed within the bores 155, 160 and the channel 210 as necessary for the load bearing requirements of the structure.

Sidewalls 135, 140 are generally not sculpted so that when the blocks 100 are assembled, the flat side walls 135, 140 collectively provide a flat wall on both the exterior and interior of the structure. The sidewalls of conventional blocks are also not sculpted but conventional blocks lack the keys and keyways provided by the novel blocks 100 to easily and quickly align the sidewalls 135, 140.

Each wall of the novel block 100 has a larger size than its conventional counterpart.

The sidewalls of a conventional cement block are flat and have a height of seven and five-eights inches (7⅝") and a length of fifteen and five-eighths inches (15⅝") as aforesaid, thereby occupying a two-dimensional area of about 0.83 square feet. Sidewalls 135, 140 of the novel blocks 100 have a height of approximately sixteen inches (16") and are approximately twenty-four inches (24") in length, thereby occupying a two-dimensional area of about 2.67 square feet which is more than three times the area covered by a conventional block. Thus, two walls of equal size, when constructed of the novel blocks 100, will require about one-third as many blocks as conventional construction, and can be constructed about three to five times faster.

The shape of the novel blocks 100 makes them resistant to earthquake damage. Significantly, each block 100 is very light in weight and is more flexible than a conventional cement block and is therefore less likely to collapse during an earthquake. These same properties also provide the block 100 with increased resistance to wind forces and increased impact resistance. If a block 100 does falls on the occupant of a structure during an earthquake, any injury may be less severe than that caused by a falling conventional block.

The novel blocks 100 are stacked and stucco may be applied to them in the same way as conventional (heavy) concrete blocks. The size and weight is such that each block 100 can be easily lifted overhead and manually set on top of other stacked blocks 100. The blocks 100 are self-aligning due to the above-disclosed sculpting and may be tacked together with standard non-expanding foam.

When the blocks 100 are assembled as shown in FIG. 5, a vertically-extending and horizontally-extending internal grid of hollow space is formed throughout the structure by the intersecting bores 155, 160 and channels 210. As the structure is assembled, rebar may be placed vertically and/or horizontally within this internal grid. The internal grid hollow space may then be filled with concrete, grout, cementitious material, or other material known in the art, thereby tying the wall together both horizontally and vertically to form a solid, load-bearing structure.

GLOSSARY OF CLAIM TERMS

Bore means a hollow space extending from and through the top wall to the bottom wall.

Channel means a hollow space extending generally from end wall to end wall.

Construction block means blocks that may be stacked in rows on top of one another to form a structure.

End-to-end relation means positioned end wall to end wall such that the end walls are generally touching.

Longitudinal means related to the length of the block (i.e., extending in the direction from end wall to end wall).

Overlying relation means stacked upon one another.

Protruded area or protrusion means a portion of a wall that extends outward from an otherwise flat wall.

Recessed area or recess means a portion of a wall that indented from an otherwise flat wall.

Transverse means related to the width of the block (i.e., extending in the direction from side wall to side wall).

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A construction block, comprising:

transversely disposed first and second end walls disposed in parallel, longitudinally spaced apart relation to one another;

longitudinally disposed first and second sidewalls disposed in parallel, transversely spaced apart relation to one another, the first and second sidewalls having a common length equal to the spacing between the first and second end walls and being formed integrally with the first and second end walls;

longitudinally disposed top and bottom walls disposed in parallel relation to one another and spaced apart from one another by a predetermined distance, the predetermined distance determined by a common height of the first and second sidewalls, the top and bottom walls being formed integrally with the first and second sidewalls, and the top and bottom walls being formed integrally with the first and second end walls;

the first end wall being recessed relative to a first end of the block;

the second end wall being protruded relative to a second end of the block, the recess of the first end wall adapted to receive the protrusion of the second end wall therein, forming a mortarless vertical joint when a first block is disposed in an end-to-end relation to a second block;

the bottom wall being recessed relative to a bottom edge of the sidewalls;

a longitudinally-extending protrusion formed in said top wall, the top wall protrusion having a width less than a width of the block;

a substantially semi-circular longitudinally-extending channel formed in the top wall protrusion, the longitudinally-extending channel positioned offset from a longitudinal axis of symmetry of the block and adapted to receive a rebar therein, and a pair of parallel, longitudinally-extending ledges formed in each block by the top wall protrusion, the ledges adapted to receive bottom edges of the first and second sidewalls forming a mortarless horizontal joint when a first block is disposed in overlying relation to a second block.

2. The block of claim 1, further comprising:

a longitudinally-extending channel formed in the bottom wall and extending from the first end wall to the second end wall;

the longitudinally-extending channel receiving the protrusion formed in the top wall when a first block is disposed in overlying relation to a second block.

3. The block of claim 2, wherein a ratio of a length, width, and height of the block is approximately 1.6:2.4:1.

4. The block of claim 2, further comprising one or more vertically-extending bores extending from the top wall to the bottom wall.

5. The block of claim 4, wherein the one or more bores are in communication with each said channel, thereby forming a continuous horizontally-extending and vertically-extending hollow space within the block.

6. The block of claim 5, wherein a continuous horizontally-extending and vertically-extending grid of hollow space is formed when a plurality of blocks are disposed in overlying relation to one another.

7. The block of claim 5, wherein the continuous horizontally-extending and vertically-extending hollow space is adapted to receive rebar therein.

8. The block of claim 5, wherein the continuous horizontally-extending and vertically-extending hollow space is adapted to receive a filling material therein.

* * * * *